US006283419B1

(12) United States Patent
Silkworth et al.

(10) Patent No.: US 6,283,419 B1
(45) Date of Patent: Sep. 4, 2001

(54) WRIST SUPPORT DEVICE

(75) Inventors: Stephanie E. Silkworth; Susan C. Silkworth, both of Baltimore, MD (US)

(73) Assignee: Steven Wayne Silkworth, Baltimore, MD (US)

( * ) Notice: Subject to any disclaimer, the term of this patent is extended or adjusted under 35 U.S.C. 154(b) by 0 days.

(21) Appl. No.: 09/627,700

(22) Filed: Jul. 28, 2000

(51) Int. Cl.[7] ..... B43L 15/00
(52) U.S. Cl. ..... 248/118.5; 248/918
(58) Field of Search ..... 248/118, 118.1, 248/118.5, 918

(56) References Cited

U.S. PATENT DOCUMENTS

| | | | | |
|---|---|---|---|---|
| 8,065 | * | 4/1851 | Goshon et al. | 248/118.5 |
| D. 366,038 | | 1/1996 | Rogers . | |
| 5,125,606 | | 6/1992 | Cassano et al. . | |
| 5,158,255 | | 10/1992 | Fuller . | |
| 5,335,888 | * | 8/1994 | Thomsen | 248/118.5 |
| 5,435,508 | | 7/1995 | Deuitch et al. . | |
| 5,470,036 | * | 11/1995 | Vu et al. | 248/118.5 |
| 5,562,270 | | 10/1996 | Montague . | |
| 5,566,913 | | 10/1996 | Prokop . | |
| 5,839,992 | | 11/1998 | Phillips . | |
| 5,948,520 | * | 9/1999 | Hirsch | 248/118.1 X |
| 6,089,516 | * | 7/2000 | Yates | 248/118 |

* cited by examiner

*Primary Examiner*—Anita King
*Assistant Examiner*—Korie Chan

(57) ABSTRACT

A wrist support device for providing support and comfort to the user's wrist while using a mouse. The wrist support device includes an elongate support member having a recessed portion disposed in a side wall thereof and being adapted to receive and support a user' wrist with the elongate support member being adapted to be controlled and rolled upon a surface by the user's wrist; and also includes high density material disposed in the elongate support member; and further includes ornamental members being disposed in the high density material.

8 Claims, 2 Drawing Sheets

WRIST SUPPORT DEVICE

BACKGROUND OF THE INVENTION

1. Field of the Invention

The present invention relates to a wrist rest and more particularly pertains to a new wrist support device for providing support and comfort to the user's wrist while using a mouse.

2. Description of the Prior Art

The use of a wrist rest is known in the prior art. More specifically, a wrist rest heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,435,508; U.S. Pat. No. 5,566,913; U.S. Pat. No. 5,125,606; U.S. Pat. No. 5,158,255; U.S. Pat. No. 5,562,270; and U.S. Pat. No. 5,839,992; U.S. Pat. No. Des. 366,038.

While these devices fulfill their respective, particular objectives and requirements, the aforementioned patents do not disclose a new wrist support device. The inventive device includes an elongate support member having a recessed portion disposed in a side wall thereof and being adapted to receive and support a user' wrist with the elongate support member being adapted to be controlled and rolled upon a surface by the user's wrist; and also includes high density material disposed in the elongate support member; and further includes ornamental members being disposed in the high density material.

In these respects, the wrist support device according to the present invention substantially departs from the conventional concepts and designs of the prior art, and in so doing provides an apparatus primarily developed for the purpose of providing support and comfort to the user's wrist while using a mouse.

SUMMARY OF THE INVENTION

In view of the foregoing disadvantages inherent in the known types of wrist rest now present in the prior art, the present invention provides a new wrist support device construction wherein the same can be utilized for providing support and comfort to the user's wrist while using a mouse.

The general purpose of the present invention, which will be described subsequently in greater detail, is to provide a new wrist support device which has many of the advantages of the wrist rest mentioned heretofore and many novel features that result in a new wrist support device which is not anticipated, rendered obvious, suggested, or even implied by any of the prior art wrist rest, either alone or in any combination thereof.

To attain this, the present invention generally comprises an elongate support member having a recessed portion disposed in a side wall thereof and being adapted to receive and support a user' wrist with the elongate support member being adapted to be controlled and rolled upon a surface by the user's wrist; and also includes high density material disposed in the elongate support member; and further includes ornamental members being disposed in the high density material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wrist support device which has many of the advantages of the wrist rest mentioned heretofore and many novel features that result in a new wrist support device which is not anticipated, rendered obvious, suggested, or even implied by any of the prior art wrist rest, either alone or in any combination thereof.

It is another object of the present invention to provide a new wrist support device which may be easily and efficiently manufactured and marketed.

It is a further object of the present invention to provide a new wrist support device which is of a durable and reliable construction.

An even further object of the present invention is to provide a new wrist support device which is susceptible of a low cost of manufacture with regard to both materials and labor, and which accordingly is then susceptible of low prices of sale to the consuming public, thereby making such wrist support device economically available to the buying public.

Still yet another object of the present invention is to provide a new wrist support device which provides in the apparatuses and methods of the prior art some of the advantages thereof, while simultaneously overcoming some of the disadvantages normally associated therewith.

Still another object of the present invention is to provide a new wrist support device for providing support and comfort to the user's wrist while using a mouse.

Yet another object of the present invention is to provide a new wrist support device which includes an elongate support member having a recessed portion disposed in a side wall thereof and being adapted to receive and support a user' wrist with the elongate support member being adapted to be controlled and rolled upon a surface by the user's wrist; and also includes high density material disposed in the elongate support member; and further includes ornamental members being disposed in the high density material.

Still yet another object of the present invention is to provide a new wrist support device that reduces the possibility of the user damaging one's wrist.

Even still another object of the present invention is to provide a new wrist support device that allows the user to freely move one's wrist upon the surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
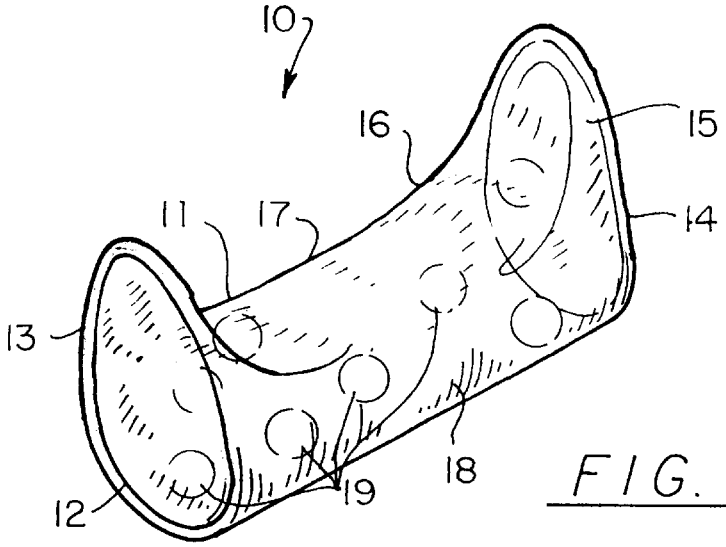
FIG. 1 is a perspective view of a new wrist support device according to the present invention.
Figure 2:
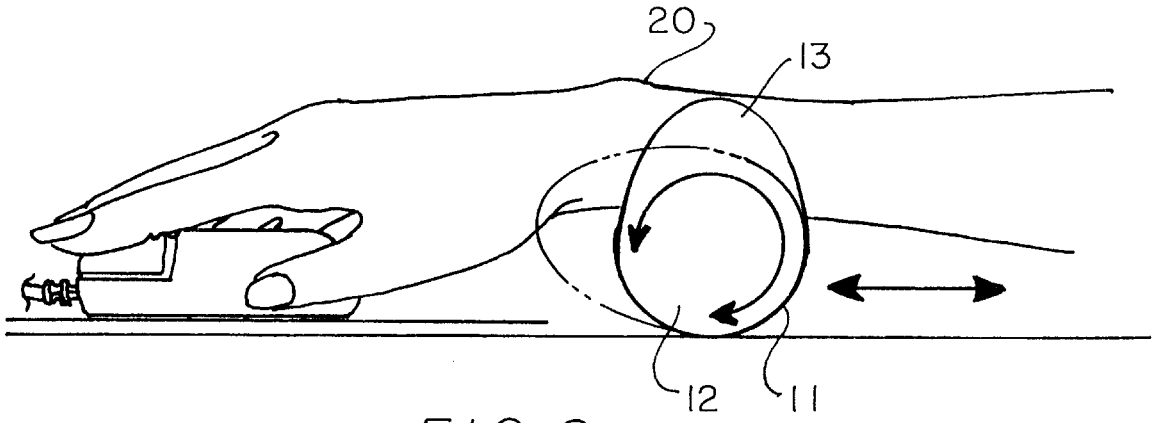
FIG. 2 is an end elevational view of the present invention shown in use.
Figure 3:
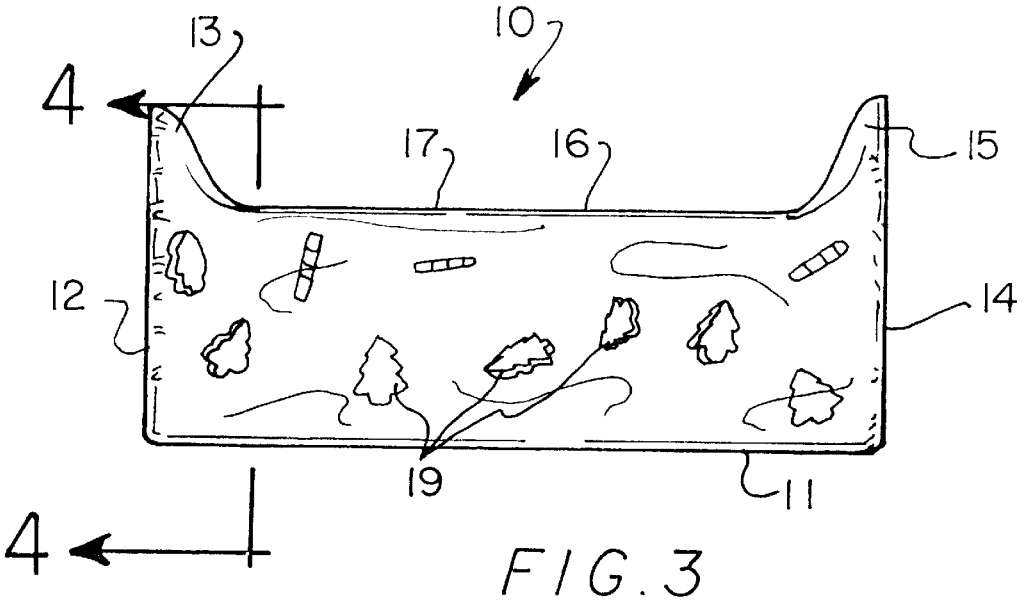
FIG. 3 is a side elevational view of the present invention.
Figure 4:
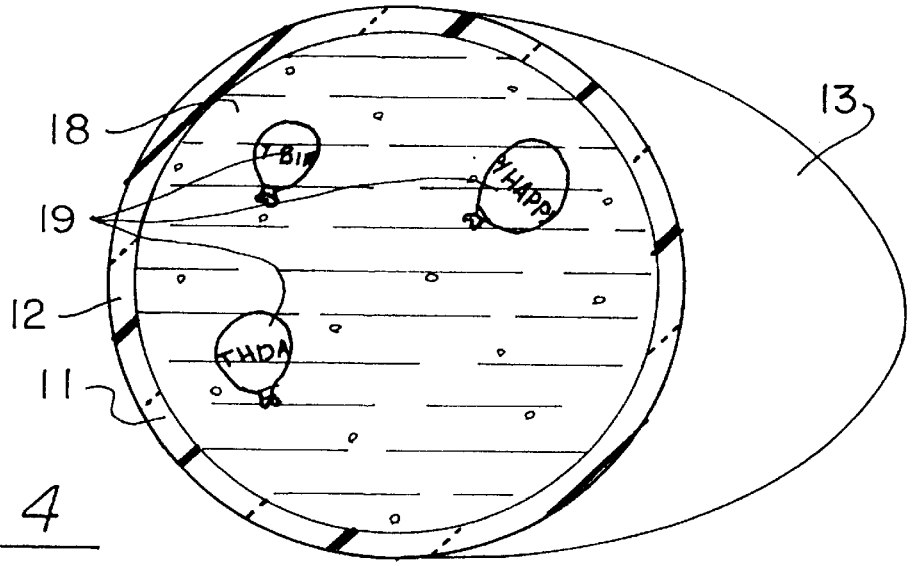
FIG. 4 is a cross-sectional view of the present invention.

With reference now to the drawings, and in particular to FIGS. 1 through 4 thereof, a new wrist support device embodying the principles and concepts of the present invention and generally designated by the reference numeral 10 will be described.

As best illustrated in FIGS. 1 through 4, the wrist support device 10 generally comprises an elongate support member 11 having a recessed portion 17 disposed in a side wall thereof and being adapted to receive and support a user' wrist 20. The elongate support member 11 is adapted to be controlled and rolled upon a surface by the user's wrist 20. The elongate support member 11 includes first and second end portions 12,14 and an intermediate portion 16 which includes the recessed portion 17. The elongate support member 11 is essentially a tubular member with the first and second end portions 12,14 having a larger diameter than that of the intermediate portion 16. Each of the first and second end portions 12,14 has a flange portion 13,15 which extends outwardly and laterally of the tubular member 11 with the flange portions 13,15 being spaced from one another and being adapted to receive the user's wrist 20 therebetween. Outer ends of the flange portions 13,15 are adapted to be level with a top of the user's wrist 20 being supported upon the recessed portion 17 of the elongate support member 11. The elongate support member 11 is made of a flexible transparent material such as plastic and rubber with the elongate support member 11 having a non-skid outer surface and having a length of approximately 4 to 7 inches, and the intermediate portion 16 having a diameter of approximately 1½ inches, and the end portions 12,14 having a diameter of approximately 2½ inches.

High density material 18 is conventionally disposed in the elongate support member 11 with the high density material 18 including a gelatinous fluid-like material. Ornamental members 19 are conventionally disposed in the high density material 18 with the ornamental members 19 including objects associated with holidays, birthdays and every day events and with the ornamental members 19 being of many different colors and being visible to outside viewers.

In use, the user places the elongate support member 11 upon a surface and places the wrist 20 of the hand being used most often for a particular task upon the recessed portion 17 of the elongate support member 11 while using one's hand to perform the task such as operating a mouse or using a computer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A wrist support device comprising:

an elongate support member having a recessed portion disposed in a side wall thereof and being adapted to receive and support a user' wrist, said elongate support member being adapted to be controlled and rolled upon a surface by the user's wrist, said elongate support member including first and second end portions and an intermediate portion between said end portions, a lobe being formed one each of said end portions, said lobes extending laterally to a longitudinal axis of said elongate member to form a recess between said lobes for resting a portion of a forearm of a user, said lobes extending in a plane in a same direction for holding the user's forearm in said recess during lateral movements of the user's forearm, said elongate member having a semi-cylindrical surface located opposite of said lobes and said recess for permitting rolling of said elongate member about the longitudinal axis thereof.

2. A wrist support device as described in claim 1, wherein said elongate support member is made of a flexible transparent material.

3. A wrist support device as described in claim 1, wherein a high density material is disposed in said elongate support member.

4. A wrist support device as described in claim 3, wherein ornamental members are disposed in said high density material, and said ornamental members include objects associated with holidays, birthdays and every day events, said ornamental members being of many different colors and being visible to outside viewers, ornamental members being disposed in said high density material.

5. A wrist support device as described in claim 1, wherein each of the end portions of the elongate support member has a substantially planar end surface.

6. A wrist support device as described in claim 1, wherein each of the end portions of the elongate support member has an end surface, each of the end surfaces having a perimeter with a semi-circular portion and a semi-oval portion.

7. A wrist support device as described in claim 1, wherein the intermediate portion of the elongate support member has a substantially circular shape.

8. A wrist support device comprising:

an elongate support member including first and second end portions and an intermediate portion between said end portions, a lobe being formed one each of said end portions, said lobes extending laterally to a longitudinal axis of said elongate member to form a recess between said lobes for resting a portion of a forearm of a user, said lobes extending in a plane in a same direction for holding the user's forearm in said recess during lateral movements of the user's forearm, said elongate member having a semi-cylindrical surface located opposite of said lobes and said recess for permitting rolling of said elongate member about the longitudinal axis thereof, said elongate support member being made of a flexible transparent material, said elongate support member having a non-skid outer surface and having a length of approximately 4 to 7 inches, said intermediate portion having a diameter of approximately 1½ inches, said end portions having a diameter of approximately 2½ inches;

high density material disposed in said elongate support member, said high density material including a gelatinous fluid-like material; and ornamental members being disposed in said high density material, said ornamental members including objects associated with holidays, birthdays and every day events, said ornamental members being of many different colors and being visible to outside viewers.

* * * * *